US008915356B1

(12) United States Patent
Cha et al.

(10) Patent No.: US 8,915,356 B1
(45) Date of Patent: Dec. 23, 2014

(54) KEY MANAGEMENT SYSTEM AND ORGANIZER

(71) Applicants: Sungwhan Cha, Irvine, CA (US); Yoonjung Kim, Irvine, CA (US)

(72) Inventors: Sungwhan Cha, Irvine, CA (US); Yoonjung Kim, Irvine, CA (US)

( * ) Notice: Subject to any disclaimer, the term of this patent is extended or adjusted under 35 U.S.C. 154(b) by 0 days.

(21) Appl. No.: 14/336,512

(22) Filed: Jul. 21, 2014

Related U.S. Application Data

(60) Provisional application No. 61/929,135, filed on Jan. 20, 2014.

(51) Int. Cl.
*A45C 11/32* (2006.01)

(52) U.S. Cl.
CPC ..... *A45C 11/323* (2013.01)
USPC ..... 206/37.3; 206/37.8

(58) Field of Classification Search
USPC ..... 206/38.1, 37.1, 37.3, 37.4, 37.8, 818
See application file for complete search history.

(56) References Cited

U.S. PATENT DOCUMENTS

| | | | | |
|---|---|---|---|---|
| 2,527,175 | A * | 10/1950 | Brill | 206/37.1 |
| 4,741,434 | A * | 5/1988 | Liebman | 206/38 |
| 5,392,622 | A * | 2/1995 | O'Donnell | 70/456 R |
| 5,511,390 | A * | 4/1996 | Mah | 63/1.14 |
| 8,096,412 | B1 * | 1/2012 | Britt | 206/37.3 |
| 8,225,634 | B2 * | 7/2012 | Giacomin et al. | 70/456 R |
| 2007/0221511 | A1 * | 9/2007 | Hetzel et al. | 206/38 |

* cited by examiner

*Primary Examiner* — Jacob K Ackun
(74) *Attorney, Agent, or Firm* — Plager Schack LLP

(57) ABSTRACT

Some embodiments of the present disclosure include a key management system and organizer for storing a plurality of keys. The key management system and organizer may include a first component and a second component, which together form a case. The first component may have a first clearance opening, a first magnet proximate to the first clearance opening, and a second magnet distal from the first clearance opening. The second component may have a second clearance opening, a first compatible magnet proximate to the second clearance opening, and a second compatible magnet distal from the second clearance opening. Each of the first component and the second component may have a pad adhered to an interior surface thereof. The first magnet and the second magnet may engage with the first compatible magnet and the second compatible magnet, creating a case having an interior configured to accommodate a plurality of keys.

10 Claims, 2 Drawing Sheets

FIG. 3
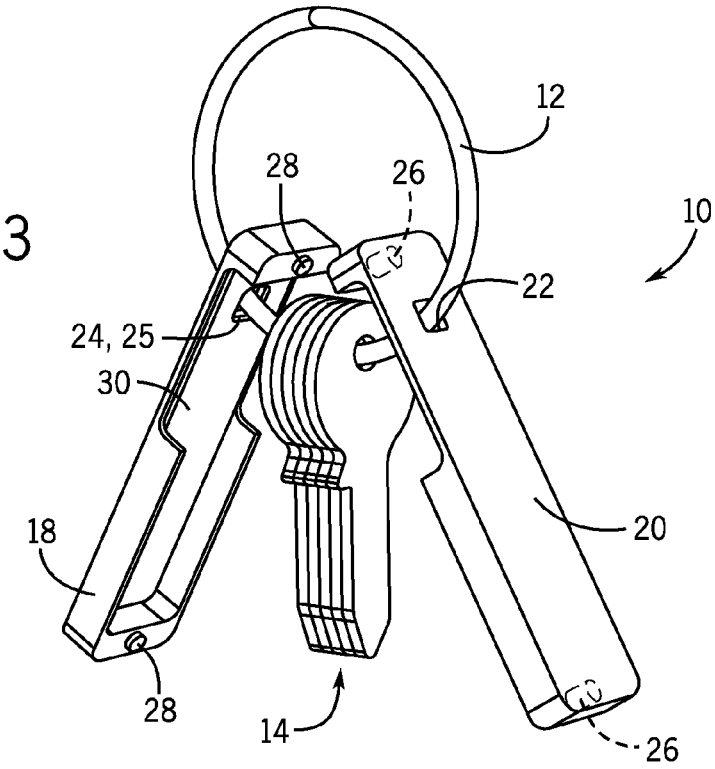
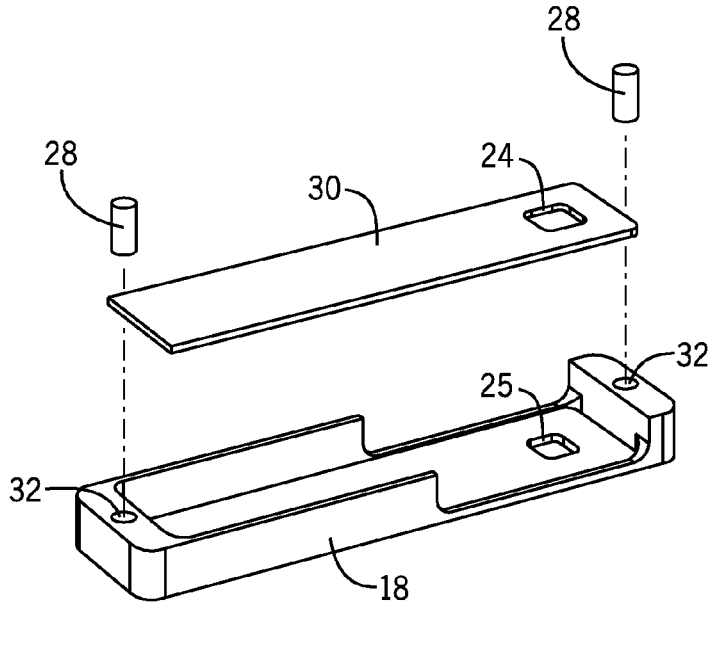
FIG. 4

KEY MANAGEMENT SYSTEM AND ORGANIZER

RELATED APPLICATION

This application claims priority to provisional patent application U.S. Ser. No. 61/929,135 filed on Jan. 20, 2014, the entire contents of which is herein incorporated by reference.

BACKGROUND

The embodiments herein relate generally to personal accessories, and more particularly, to a key management system and organizer Keys are conventionally stored on a key ring or key chain. Conventional key chains are bulky, the keys jingle, and the sharp edges of the keys can poke into thighs, hands, and other objects. There are some key chains that attempt to solve these problems. Primarily, these key chains function similar to a Swiss Army knife, wherein the keys pivot out of a housing. However, the Swiss Army knife-style key chains result in stacked keys, wherein the keys in the central portion of the stack are difficult to access. The screws that keep the housing together often become loose and, when tightened too much, the keys are hard to access.

Therefore, what is needed is a key management system and organize that enables easy access to keys, when needed for use, yet holds the keys securely together in a case such that the keys do not jingle, nor do the edges of the keys have the ability to stab a user.

SUMMARY

Some embodiments of the present disclosure include a key management system and organizer for storing a plurality of keys. The key management system and organizer may include a first component and a second component, which together form a case. The first component may have a first clearance opening, a first magnet proximate to the first clearance opening, and a second magnet distal from the first clearance opening. The second component may have a second clearance opening, a first compatible magnet proximate to the second clearance opening, and a second compatible magnet distal from the second clearance opening. Each of the first component and the second component may have a pad adhered to an interior surface thereof. The first magnet and the second magnet may engage with the first compatible magnet and the second compatible magnet, creating a case having an interior configured to accommodate a plurality of keys.

BRIEF DESCRIPTION OF THE FIGURES

The detailed description of some embodiments of the invention is made below with reference to the accompanying figures, wherein like numerals represent corresponding parts of the figures.

FIG. 3 is a perspective view of one embodiment of the present invention, showing the embodiment in an open configuration.

FIG. 4 is a detail perspective view of one embodiment of the present invention.

DETAILED DESCRIPTION OF CERTAIN EMBODIMENTS

In the following detailed description of the invention, numerous details, examples, and embodiments of the invention are described. However, it will be clear and apparent to one skilled in the art that the invention is not limited to the embodiments set forth and that the invention can be adapted for any of several applications.

The device of the present disclosure may be used to store and manage a set of keys and may comprise the following elements. This list of possible constituent elements is intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device.

1. Case
2. Padding
3. Fasteners

The various elements of the key management system and organizer of the present disclosure may be related in the following exemplary fashion. It is not intended to limit the scope or nature of the relationships between the various elements and the following examples are presented as illustrative examples only.

Figure 1:
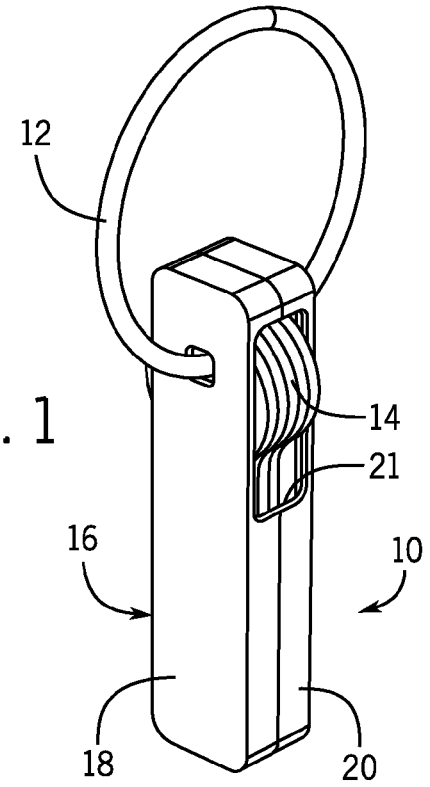
FIG. 1 is a perspective view of one embodiment of the present invention.
Figure 2:
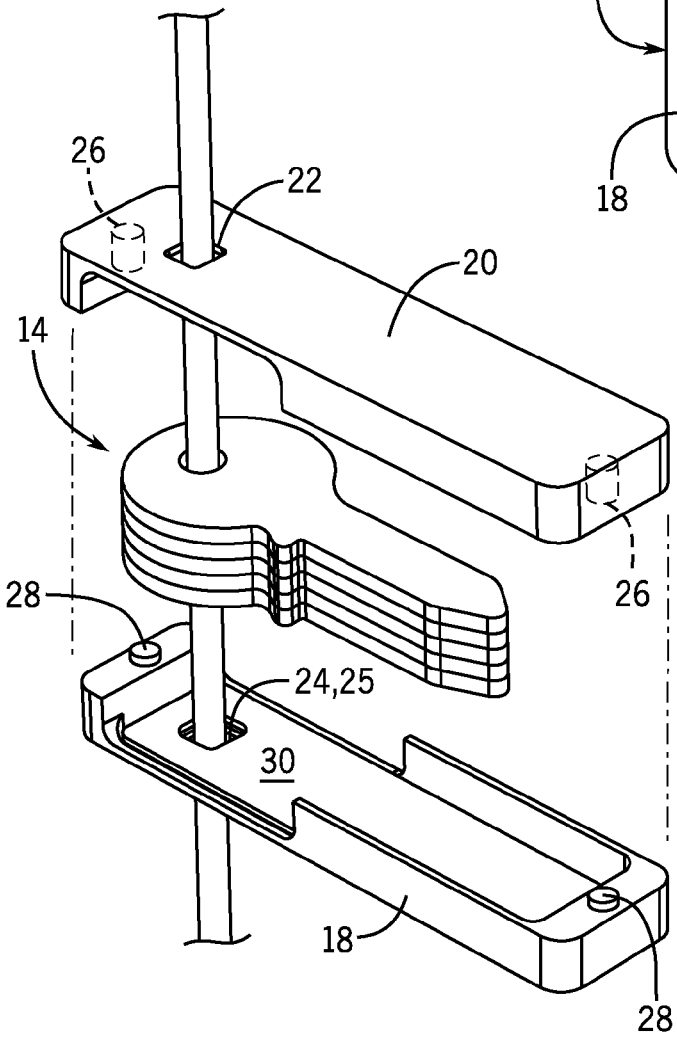
FIG. 2 is an exploded perspective view of one embodiment of the present invention.

By way of example, and referring to FIGS. 1-4, some embodiments of the key management system and organizer 10 of the present disclosure comprise a case 16 comprising a first component 18 and a second component 20, wherein the first component 18 and the second component 20 are configured to removably attach to one another, forming a case 16 having an interior, wherein the interior is configured to accommodate a plurality of keys 14. In some embodiments, the first component 18 and the second component 20 are removably attached to one another using magnets 26, 28. For example, the first component 18 may comprise a first magnet 28 proximate to the clearance opening 24 and a second magnet 28 proximate to an end of the first component 18 distal from the clearance opening; the second component 20 may comprise a first compatible magnet 26 proximate to the clearance opening 22 and a second compatible magnet 26 proximate to an end of the second component 20 distal from the clearance opening 22, wherein the first magnet 28 and the first compatible magnet 26 are configured to engage, the second magnet 28 and the second compatible magnet 26 are configured to engage, and when the first magnet 28 is engaged with the first compatible magnet 26 and the second magnet 28 is engaged with the second compatible magnet 26, the case is in a closed configuration, as shown in FIG. 1. In embodiments, magnets 26, 28 may be mounted within magnet mounting holes 32 in each of the components, as shown in FIG. 4. In other embodiments, the first component 18 and the second component 20 may be removably attached using any other conventional fastener. However, when magnets 26, 28 are used to connect the first component 18 and the second component 20, the case 16 may be more easily opened and, thus, keys 14 may be more easily accessed than when other fasteners are used. Specifically, when magnets 26, 28 are used, a user may be able to use the key management system and organizer 10 using only one hand.

Each of the first component 18 and the second component 20 may comprise an inner surface to which a pad 30, such as a foam pad, may be adhered. The pad 30 may ensure that the keys 14 are held securely in place in the case 16 and may also absorb the noise associated with keys 14 contacting each other, while also preventing the keys 14 from moving.

At least one key 14, such as a house key, a mail key, or a car key, may be placed between the first component 18 and the second component 20 of the case 16. A ring 12 may be threaded through a hole in each key 14, and through a clearance opening 22, 24, 25 in each of the first component 18, the second component 20, and the pad 30 as shown in FIG. 3, such that the key management system and organizer 10 may be used with any standard key ring 12 or other wired loop. Thus, the clearance opening in each of the first component 18, the second component 20, and the pad 30 may be configured to align with a hole on the head of a key. The first component 18 and the second component 20 may then be magnetically closed by magnets 26, 28 positioned proximate to the clearance openings 22, 24, 25 and by magnets 26, 28 positioned proximate to an end of the case 16 distal from the ring 12. When the case 16 is closed, the case 16 may conceal at least a portion of the keys 14, as shown in FIG. 1. As shown in FIG. 1, some embodiments of the case 16 comprise an opening 21, wherein the head portion of the keys 14 may extend partially there through. Therefore, the case 16 of the present disclosure may be compatible with keys 16 having many different shapes and sizes.

When the first component 18 and the second component 20 are unattached from each other, the case 16 may be in an open configuration, as shown in FIG. 3. When the case 16 is in an open configuration, the keys 14 are released and can be used as normal. Because of the magnetic closing mechanism, the case 16 may be opened using only one hand. Thus, in some embodiments, the key management system and organizer of the present disclosure may not comprise any screws, bolts, or other fasteners other than magnets.

The key management system and organizer 10 of the present disclosure may be made of any suitable material and, in some embodiments, the first component 18 and the second component 20 may be made of hard anodized aluminum. In other embodiments, the first component 18 and the second component 20 may comprise any other suitable material, such as a plastic material. The magnets may comprise any magnets, such as neodymium magnets, and may be adhered to each of the first component and the second component using an adhesive, such as glue. The pads may be foam and may comprise a polyvinyl chloride (PVC) foam, wherein a surface of the pad may comprise an adhesive for attachment to the inner surface of the first and the second component. Alternatively, the pads may comprise any other suitable material. The ring may comprise any desired ring or loop and, in some embodiments, is a stainless steel wire. In embodiments, the loop may comprise a detachable locking system as well.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A key management system and organizer for storing keys, the key management system and organizer comprising:

a case comprising a first component and a second component, wherein the first component and the second component interact to form the case having an interior, wherein the interior is configured to accommodate a plurality of keys; and a pad adhered to an inner surface of at least one of the first component and the second component, wherein the first component, the second component, and the pad comprise a clearance opening configured to align with an opening on a head of a key and configured to engage with a ring.

2. The key management system and organizer of claim 1, wherein:

the first component comprises a first magnet proximate to the clearance opening and a second magnet proximate to an end of the first component distal from the clearance opening;

the second component comprises a first compatible magnet proximate to the clearance opening and a second compatible magnet proximate to an end of the second component distal from the clearance opening;

the first magnet and the first compatible magnet are configured to engage;

the second magnet and the second compatible magnet are configured to engage; and when the first magnet is engaged with the first compatible magnet and the second magnet is engaged with the second compatible magnet, the case is in a closed configuration.

3. The key management system and organizer of claim 2, wherein each of the magnets are mounted in respective mounting holes positioned on each of the first component and the second component.

4. The key management system and organizer of claim 1, wherein a first pad is adhered to the inner surface of the first component and a second pad is adhered to the inner surface of the second component.

5. The key management system and organizer of claim 1, wherein, when the case is in a closed configuration, the case comprises an opening configured to engage with a head of each of the keys.

6. The key management system and organizer of claim 1, wherein the pad is a polyvinyl chloride (PVC) foam pad.

7. A key management system and organizer for storing a plurality of keys, the key management system and organizer comprising:

a first component comprising a first clearance opening, a first magnet proximate to the first clearance opening, and a second magnet distal from the first clearance opening;

a second component comprising a second clearance opening, a first compatible magnet proximate to the second clearance opening, and a second compatible magnet distal from the second clearance opening; and a first pad adhered to an interior surface of the first component and a second pad adhered to an interior surface of the second component, wherein:

the first magnet and the second magnet are configured to engage with the first compatible magnet and the second compatible magnet, creating a case comprising the first component and the second component; and the case comprises an interior configured to accommodate a plurality of keys.

8. The key management system and organizer of claim 7, wherein the case comprises an opening configured to engage with a head of each of the keys.

9. The key management system and organizer of claim 7, wherein the first clearance opening and the second clearance opening are configured to align with an opening in a head of a key.

10. The key management system and organizer of claim 9, wherein the first clearance opening and the second clearance opening are configured to engage with a ring.

* * * * *